US009347118B2

(12) United States Patent
Conduit et al.

(10) Patent No.: US 9,347,118 B2
(45) Date of Patent: May 24, 2016

(54) ALLOY COMPOSITION

(71) Applicant: ROLLS-ROYCE PLC, London (GB)

(72) Inventors: Bryce David Conduit, Farnham (GB); Gareth John Conduit, Cambridge (GB); Howard James Stone, Cambridge (GB); Mark Christopher Hardy, Belper (GB)

(73) Assignee: ROLLS-ROYCE plc, London (GB)

( * ) Notice: Subject to any disclaimer, the term of this patent is extended or adjusted under 35 U.S.C. 154(b) by 235 days.

(21) Appl. No.: 14/224,885

(22) Filed: Mar. 25, 2014

(65) Prior Publication Data

US 2014/0322068 A1 Oct. 30, 2014

(30) Foreign Application Priority Data

Apr. 26, 2013 (GB) ..... 1307535.3

(51) Int. Cl.
*C22C 37/04* (2006.01)
*C22C 27/04* (2006.01)

(52) U.S. Cl.
CPC ..... *C22C 27/04* (2013.01)

(58) Field of Classification Search
CPC ..... C22C 27/04
See application file for complete search history.

(56) References Cited

U.S. PATENT DOCUMENTS

| | | | | |
|---|---|---|---|---|
| 2,850,385 | A * | 9/1958 | Nisbet | C22C 27/04 420/429 |
| 3,184,834 | A * | 5/1965 | Bechtold | C04B 35/58092 252/512 |
| 3,275,434 | A | 9/1966 | Chang | |
| 3,479,155 | A | 11/1969 | Rudy | |
| 5,082,625 | A | 1/1992 | Kato et al. | |
| 5,316,723 | A | 5/1994 | Perfect | |
| 6,066,191 | A * | 5/2000 | Tanaka | C22C 1/045 419/1 |
| 6,248,292 | B1 * | 6/2001 | Ando | B23K 35/3093 420/10 |
| 2009/0136381 | A1 | 5/2009 | Tin et al. | |
| 2012/0003486 | A1 * | 1/2012 | Rozak | C22C 27/04 428/457 |

FOREIGN PATENT DOCUMENTS

| | | |
|---|---|---|
| DE | 35 30 837 A1 | 3/1987 |
| EP | 2 065 479 A2 | 6/2009 |
| GB | 670555 | 4/1952 |
| JP | A-5-171340 | 7/1993 |
| JP | A-5-179378 | 7/1993 |

OTHER PUBLICATIONS

Sep. 12, 2014 Search Report issued in European Application No. 14161529.
Schmidt, F.F., et al., "The Engineering Properties of Molybdenum Alloys," 9 pages.
British Search Report issued in British Patent Application No. GB1307535.3 on Oct. 2, 2013.

* cited by examiner

*Primary Examiner* — Jessee Roe
*Assistant Examiner* — Christopher Kessler
(74) *Attorney, Agent, or Firm* — Oliff PLC

(57) ABSTRACT

A molybdenum based alloy composition including between 15% and 20% niobium and 0.05% and 0.25% carbon.

13 Claims, 1 Drawing Sheet

ALLOY COMPOSITION

FIELD OF THE INVENTION

The present invention relates to an alloy composition, particularly though not exclusively, to an alloy composition suitable for use in refractory (i.e. high temperature) applications. The invention further relates to a forging die comprising the alloy composition.

BACKGROUND TO THE INVENTION

Prior alloy compositions comprising molybdenum are known, particularly for use in refractory applications such as fusion and fission reactors, rocket engine nozzles, furnace structural component and forging dies. Such applications require high hardness (as measured according to the Vickers hardness test) at a particular operating temperature. However, known molybdenum based alloy compositions have insufficient strength for some applications, particularly at high temperatures such as 1000 to 1100° C., and may have a high cost of production.

Examples of compositions of prior molybdenum based alloys are given in table 1, given in terms of weight percentages. TZM is described in further detail in U.S. Pat. No. 3,275,434. Further prior molybdenum based alloys are described in "The Engineering Properties of Molybdenum Alloys" by F F Schmidt and H R Ogden.

Each of these prior alloys may also comprise an amount of Rhenium. The inclusion of rhenium in a molybdenum alloy is thought to improve ductility, recrystallization temperature and strength. However, rhenium is an expensive elemental addition, due to its relative scarcity in the earth's crust. Rhenium containing alloys may therefore have an unacceptably high cost.

The present invention describes an alloy composition and an article comprising the alloy composition which seeks to overcome some or all of the above problems. All percentage amounts are given in terms of weight percentages unless otherwise specified.

SUMMARY OF THE INVENTION

According to a first aspect of the invention, there is provided an alloy composition comprising molybdenum, wherein the composition comprises between 15% and 20% niobium and 0.05% and 0.25% carbon.

Advantageously, the described alloy has a high hardness at temperatures of between 1,000 and 1,100° C., and is consequently suitable for a wide range of uses, including for example refractory articles. The relatively high amount of niobium compared to prior compositions has been found to form niobium carbide (HfC), which acts as a strengthener. Furthermore, niobium is a relatively inexpensive element in comparison to other strengtheners, resulting in an alloy composition having a high strength at the required temperatures, and a relatively low overall cost.

Preferably, the alloy composition may comprise between 16% and 17% niobium, and may comprise between 16.1 and 16.5% niobium, and preferably may comprise approximately 16.3% niobium.

The alloy composition may further comprise hafnium, and may further comprise between 0.5% and 4% hafnium, and may comprise between 0.7% and 0.9% hafnium, and preferably may comprise approximately 0.8% hafnium. The inclusion of hafnium in the alloy composition has been found to form hafnium carbide (HfC), which acts as a strengthener in addition to the strengthening provided by the niobium carbide. Depending on the application, sufficient strengthening may be provided only by niobium. However, hafnium can be used to provide further strengthening, though at a comparatively high cost.

The alloy may further comprise titanium, and may comprise between 1% and 3% titanium, may comprise between 1.3% and 1.5% titanium, and may comprise substantially 1.42% titanium. The titanium may be in the form of titanium oxide ($TiO_2$). $TiO_2$ has been found to further increase the strength of the alloy by providing dispersion strengthening, and/or solid solution strengthening.

The alloy may further comprise tungsten, and may comprise between 1% and 10% tungsten, may comprise between 2.7% and 2.9% tungsten, and may comprise substantially 2.8% tungsten. The addition of tungsten is thought to act as a solid solution strengthener, thereby increasing the strength of the alloy.

The balance of the composition may comprise molybdenum. The alloy may further comprise incidental impurities. The alloy may consist substantially only of molybdenum, niobium, titanium, carbon, hafnium, tungsten, oxygen and incidental impurities.

The alloy composition may further comprise oxygen or metal oxides. The presence of metal oxides in the alloy composition is thought to provide dispersion solution strengthening, which will further increase the strength of the alloy.

The alloy composition may have an ultimate tensile strength of between approximately 380 MPa and 460 MPa at a temperature of 1,000° C.

According to a second aspect of the invention there is provided an article comprising an alloy composition in accordance with the first aspect of the invention.

The article may comprise a forging die. The alloy is particularly suitable for in use in a forging die, since the alloy provides a very high strength at high temperatures.

BRIEF DESCRIPTION OF THE DRAWINGS

Table 1 describes prior alloy compositions;

Table 2 describes an alloy composition in accordance with the present invention;

Figure 1:
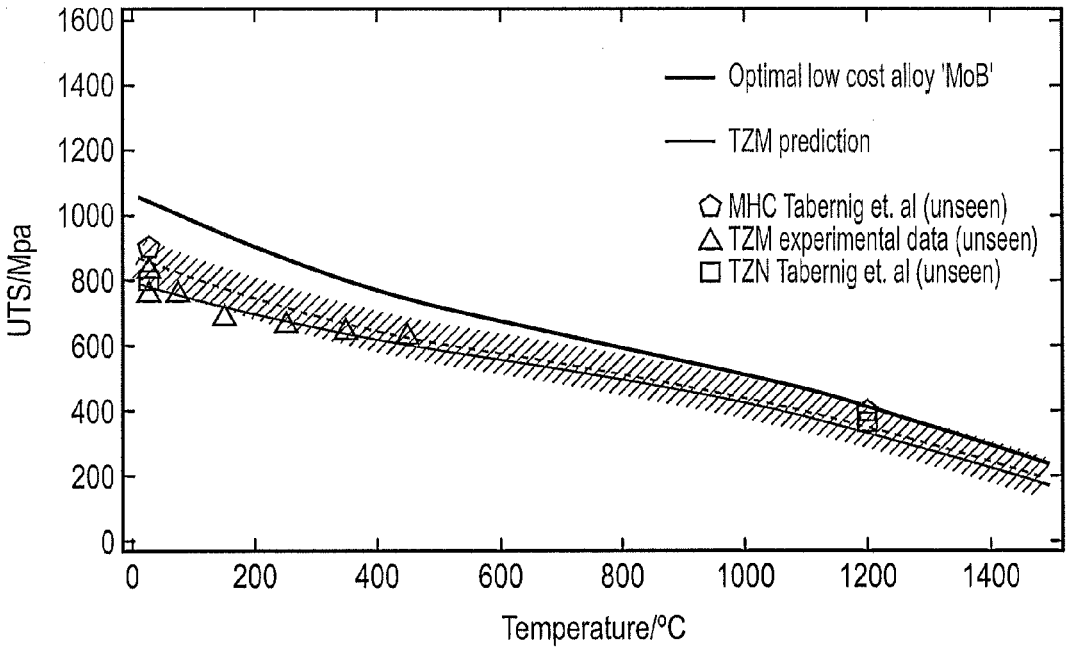
Figure 2:
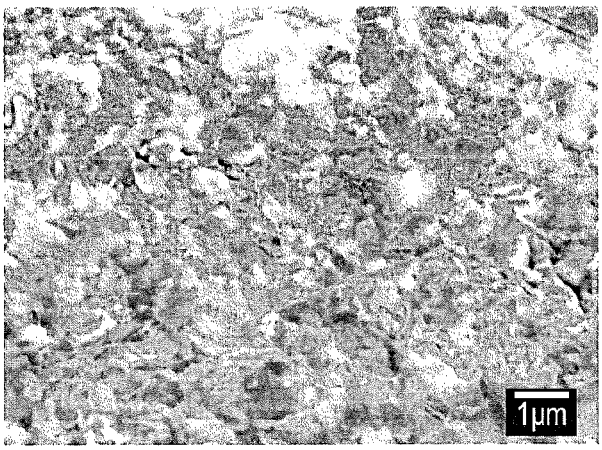

Table 3 describes an example of an alloy composition in accordance with the present invention;

FIG. 1 is a graph comparing the relationship between the temperature and the ultimate tensile strength of compositions described in tables 1 and 3; and FIG. 2 shows a back scattered electron image of the microstructure of the composition described in table 3.

DETAILED DESCRIPTION

Table 2 shows the compositional ranges of an alloy composition, while table 3 shows an example composition of the first alloy composition. A back scattered electron image of the microstructure of the composition of table 3 is shown in FIG. 2. As shown in FIG. 1, the nominal alloy composition is thought to have an ultimate tensile strength (UTS) of between approximately 380 MPa and 460 MPa at a temperature of 1,000° C., which is supported by evidence from Vicker's hardness tests. This is an improvement in UTS of approximately 50 to 250 MPa at a temperature of 1,000° C. compared to prior molybdenum based alloy compositions such as TZM. In general, it has been found that an alloy composition comprising molybdenum, between 15% and 20% niobium and 0.05% and 0.25% carbon provides advantages over prior molybdenum alloy compositions.

The presence of niobium in the amounts specified in table 2 is thought to increase the strength of the composition by the formation of strengthening niobium carbide (NbC). In the example composition, it is thought that the niobium carbide in the composition is responsible for the majority of the strengthening effects.

The presence of hafnium in the amounts specified in table 2 is thought to further increase the strength of the composition at both high and low temperatures, both by forming hafnium carbides (HfC) and solid solution strengthening.

The presence of titanium in the specified amounts promotes the formation of dispersion strengthening titanium dioxide ($TiO_2$), which has the effect of further increasing the strength of the alloy composition.

The presence of tungsten in the amounts specified in table 2 is also thought to further increase the strength of the composition by the formation of strengthening tungsten carbide (WC). However, it is thought that the tungsten carbide has a relatively small contribution to the strengthening of the composition, and so may optionally be omitted from the composition, particularly in view of the increased processing costs inherent in tungsten containing alloy compositions. Indeed, an alloy comprising only molybdenum, hafnium and carbon in the amounts specified is necessary to provide an alloy having superior tensile strength at high temperatures relative to prior alloys.

The composition may further comprise a trace amount of zirconium.

A method of forming the alloy is described below. The alloy is produced by a powder processing method. The powder processing method comprises melting and gas atomisation to form particles having a diameter of less than approximately 5 μm. A billet is then formed by hot isostatic pressing (HIP) of the particles. During the hot HIP step, the powder is subjected to heat at temperatures of approximately 2000° C. at approximately 100 Mpa for approximately 4 hours.

FIG. 2 shows a sample of alloy having the composition described in table 3. The sample was produced using an arc-cast method. The lighter areas of the sample are hafnium carbide precipitates within the alloy matrix. As can be seen, the hafnium carbide precipitates are segregated to the interdentritic regions with molybdenum rich primary dendrites in the sample. More uniform, fine dispersions of hafnium carbide can be produced using a powder metallurgy process. This will be expected to improve the properties of the alloy further.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

For example, the composition may comprise further elements. The alloy may be formed using different processes.

TABLE 1

| Prior Compositions (weight percent) | | | | | |
|---|---|---|---|---|---|
| | Titanium | Carbon | Zirconium | Hafnium | Molybdenum |
| TZM | 0.5 | 0.02 | 0.08 | — | Balance |
| TZC | 1.3 | 0.1 | 0.3 | — | Balance |
| MHC | — | 0.05-1.5 | — | 0.8-1.4 | Balance |
| ZHM | — | 0.12 | 0.4 | 1.2 | Balance |

TABLE 2

| | wt. % | |
|---|---|---|
| | Max | Min |
| Mo | bal. | bal. |
| Nb | 17 | 16 |
| Ti | 1.5 | 1.3 |
| C | 0.15 | 0.25 |
| Zr | — | — |
| Hf | 0.9 | 0.7 |
| W | 2.9 | 2.7 |

TABLE 3

| | wt. % |
|---|---|
| Mo | bal. |
| Nb | 16.3 |
| Ti | 1.42 |
| C | 0.2 |
| Zr | — |
| Hf | 0.8 |
| W | 2.8 |

The invention claimed is:

1. An alloy composition comprising molybdenum, wherein the composition comprises between 15% and 20% niobium and 0.05% and 0.25% carbon, between 0.5% and 4% hafnium, between 1% and 3% titanium, and between 1% and 10% tungsten, wherein the balance comprises molybdenum, oxygen and incidental impurities.

2. An alloy composition according to claim 1, wherein the composition comprises between 16% niobium and 16.5% niobium.

3. An alloy composition according to claim 1, wherein the composition comprises between 0.19% carbon and 0.21% carbon.

4. An alloy composition according to claim 1, wherein the composition comprises between 0.7% and 0.9% hafnium.

5. An alloy composition according to claim 1, wherein the composition comprises between 1.3% and 1.5% titanium.

6. An alloy composition according to claim 1, wherein the composition comprises between 2.7% and 2.9% tungsten.

7. An alloy composition according to claim 1, wherein the composition consists essentially of molybdenum, niobium, titanium, carbon, hafnium, tungsten, oxygen and incidental impurities.

8. An alloy composition according to claim 1, wherein the titanium is in the form of titanium oxide.

9. An alloy composition according to claim 1, wherein the composition consists of molybdenum, niobium, titanium, carbon, hafnium, tungsten, oxygen and incidental impurities, and optionally a trace amount of zirconium.

10. An alloy composition according to claim 1 having an ultimate tensile strength of between approximately 380 MPa and 460 MPa at a temperature of 1,000° C.

11. An article comprising an alloy composition according to claim 1.

12. An article comprising an alloy composition according to claim 7.

13. An article comprising an alloy composition according to claim 9.

* * * * *